US006485315B1

(12) United States Patent
Hwang

(10) Patent No.: US 6,485,315 B1
(45) Date of Patent: Nov. 26, 2002

(54) ELECTRICAL PLUG CONNECTOR WITH SPRING LATCH AND GROUNDING TABS

(75) Inventor: Jneq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/027,268

(22) Filed: Dec. 20, 2001

(51) Int. Cl.[7] ..... H01R 13/648
(52) U.S. Cl. ..... 439/108; 439/610; 439/358
(58) Field of Search ..... 439/95, 108, 607–610, 439/357, 358

(56) References Cited

U.S. PATENT DOCUMENTS 5,934,939 A * 8/1999 Thenaisie et al. ..... 439/607
6,290,530 B1 * 9/2001 Chang ..... 439/357
6,328,601 B1 * 12/2001 Yip et al. ..... 439/610
6,431,887 B1 * 8/2002 Yeomans et al. ..... 439/108

* cited by examiner

*Primary Examiner*—Hien Vu
(74) *Attorney, Agent, or Firm*—Wei Te Chung

(57) ABSTRACT

A plug-type electrical connector includes a housing (10), an insert (20), a number of contacts (50), a conductive grounding clip (40) and a plastic spring latch (30). The contacts mount in the housing, the latch and grounding clip both clamp to a front of the insert, and the insert is mounted to a top of the housing. The grounding clip is formed in the shape of an elongate ring, with a front end bended downward to form a hook to clamp the front of the insert, and a rear end bended upward to electrically engage with a grounding surface of a mating receptacle (2). The spring latch has a lock (31) on a top surface to engage with an aperture (7) in the receptacle connector. The spring latch and the grounding clip are both more difficult to permanently deform during use than prior art metallic clips.

4 Claims, 7 Drawing Sheets

ELECTRICAL PLUG CONNECTOR WITH SPRING LATCH AND GROUNDING TABS

BACKGROUND OF THE INVENTION

1. Field of the Invention

The present invention relates to an electrical connector, and particularly to a small form factor plug connector for high speed data transmission which has a plastic spring latch and separate conductive grounding tabs.

2. Brief Description of the Prior Art

Referring to FIG. 9, a prior art concept for a small form factor plug connector 700 and complementary receptacle connector 800 are shown. The plug connector 700 has a main body 710, an insert 720, a plurality of contacts 730, and a conductive metal latch 740. A front portion 742 of the latch 740 is attached between the main body 710 and the insert 720. A rear portion 744 of the latch 740 connects to a rear end of the insert 720. A central portion 746 of the latch 740 extends in an arc between the front portion 742 and the rear portion 744. A lock 748 sits atop the central portion 746.

The mating receptacle connector 800 has a conductive shell 810, roughly rectangular in shape and having an opening 820 for insertion of a front end of the mating plug connector 700. A window 830 is defined in an upper wall 815 of the shell 810 for engaging with the lock 748 of the latch 740 on the plug connector 700. The latch 740 serves a second purpose of establishing electrical grounding contact with the shell 810 of the receptacle. The latch 740 is quite long, and if the plug 700 is inserted into the receptacle 800 at a high angle, the latch 740 can be easily bent so that it no longer locks with the window 830, and further, so that it no longer provides a reliable grounding contact between the plug connector 700 and the receptacle connector 800.

Referring to FIG. 10, patent application Ser. No. 09/826,995, having the same assignee as the present application, discloses an electrical connector 901 having a housing 910 which includes an upper half 912 and a lower half 911. A plastic latch 920 is rotatably mounted between the lower half 911 and a pair of retaining tabs 915, which are integrally a part of the upper half 912. A coil spring 926 arranged between the latch 920 and the upper half 912 biases the latch 920 in an upward position. A grounding tab 930 is fixed to the upper half 912, and has a pair of spring arms 932 for electrically contacting a wall of a mating receptacle connector (not shown). Two retaining posts 940 of the upper half 912 can insert through holes 941 in the spring arms 932 and can be deformed into enlarged heads, thereby retaining the grounding tab 930 to the housing 910. The retaining tabs 915 are vulnerable to being bent, and the inclusion of the coil spring 926 and the requirement for deforming the retaining posts 940 unnecessarily complicates manufacture of the connector 901, increasing manufacturing costs.

An improved plug connector with a more robust latch design is desired to overcome the limitations of the prior art.

BRIEF SUMMARY OF THE INVENTION

A first object of the present invention is to provide a small form factor plug connector which has a robust latching mechanism for locking the plug connector into a mating receptacle connector;

A second object of the present invention is to provide a small form factor plug connector which has a ground tab which reliably establishes an electrical connection with the mating receptacle connector.

A third objective of the present invention is to provide a small form factor plug connector which is easily and cheaply manufactured.

To achieve the above-mentioned objects, a plug connector in accordance with the present invention includes a housing, an insert, a plurality of contacts, a plastic spring latch, and a metallic grounding clip.

The housing has two sidewalls with a bed, a front shelf, and a top beam connecting the two sidewalls together. The contacts are mounted in the housing and are accessible at the front shelf for connecting with terminals of a mating receptacle connector.

The insert is slab-shaped and forms a thin tongue at a center of its forward end. The tongue is flanked by a pair of thicker support beams, which are flanked by side beams.

The grounding clip is made of a metallic material and is ring-shaped. The grounding clip is bended downward into a hook at its forward end to allow it to clamp to the support beams at the forward end of the insert. The grounding clip bends upward at its rearward half to electrically contact a grounding surface of the receptacle.

The spring latch is elongate and forms a hook at its front end to clamp to the tongue of the insert. A lock is formed on an upper surface of the spring latch for engaging with an aperture cut in the receptacle connector to lock the plug connector to the receptacle connector. The spring latch is made of plastic and is of such a design that it will not permanently deform in normal use.

The insert attaches to a top of the housing, completing assembly of the plug connector. The advantage of the present invention over the prior art is that the spring latch is more durable and provides for easier assembly than that of the prior art, and the grounding clip is more protected from permanent distortion and is simpler in design.

Other objects, advantages and novel features of the present invention will become more apparent from the following detailed description of the present embodiment when taken in conjunction with the accompanying drawings.

DETAILED DESCRIPTION OF THE INVENTION

Figure 1:
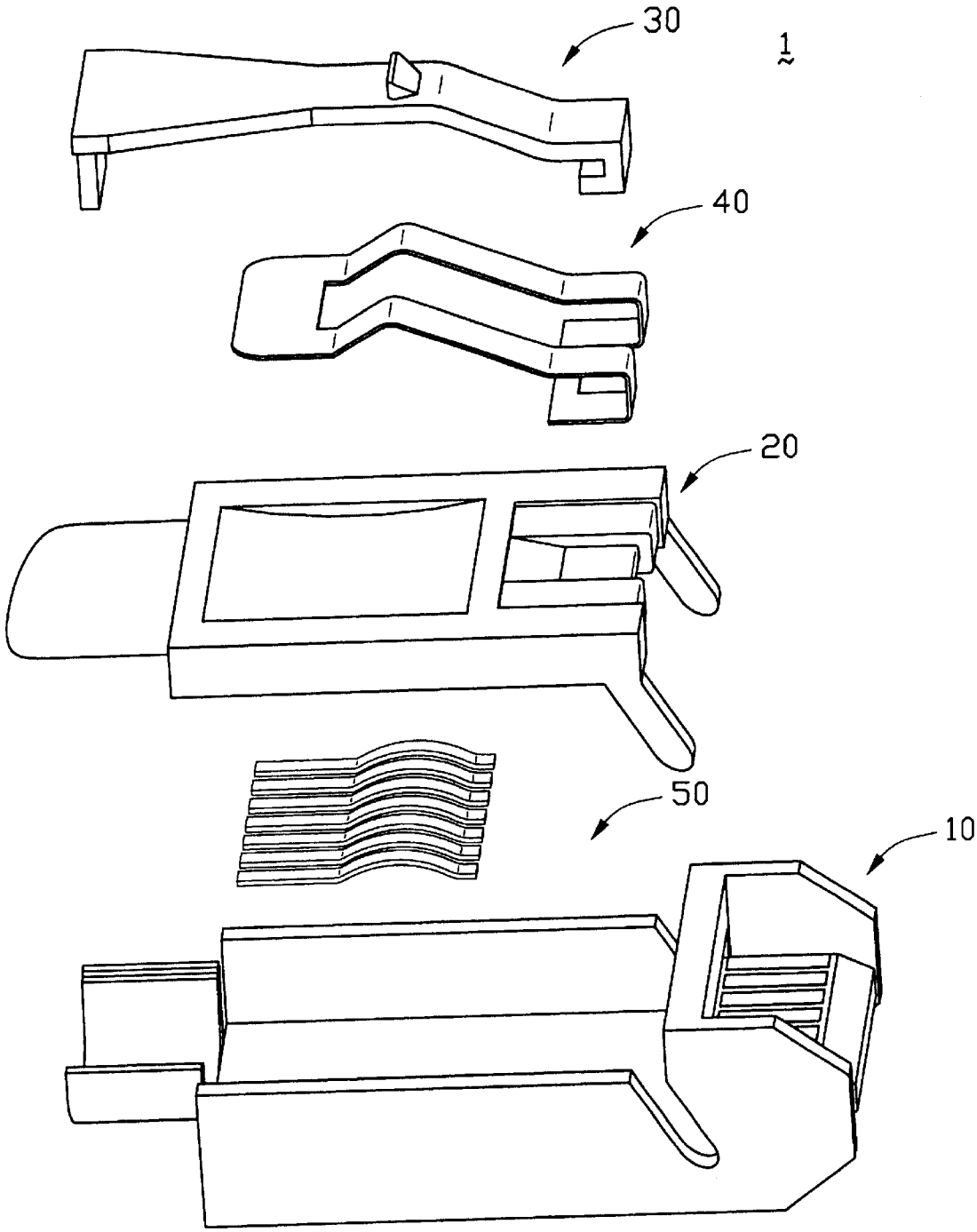
FIG. 1 is an exploded view of a plug connector in accordance with the present invention.
Figure 6:
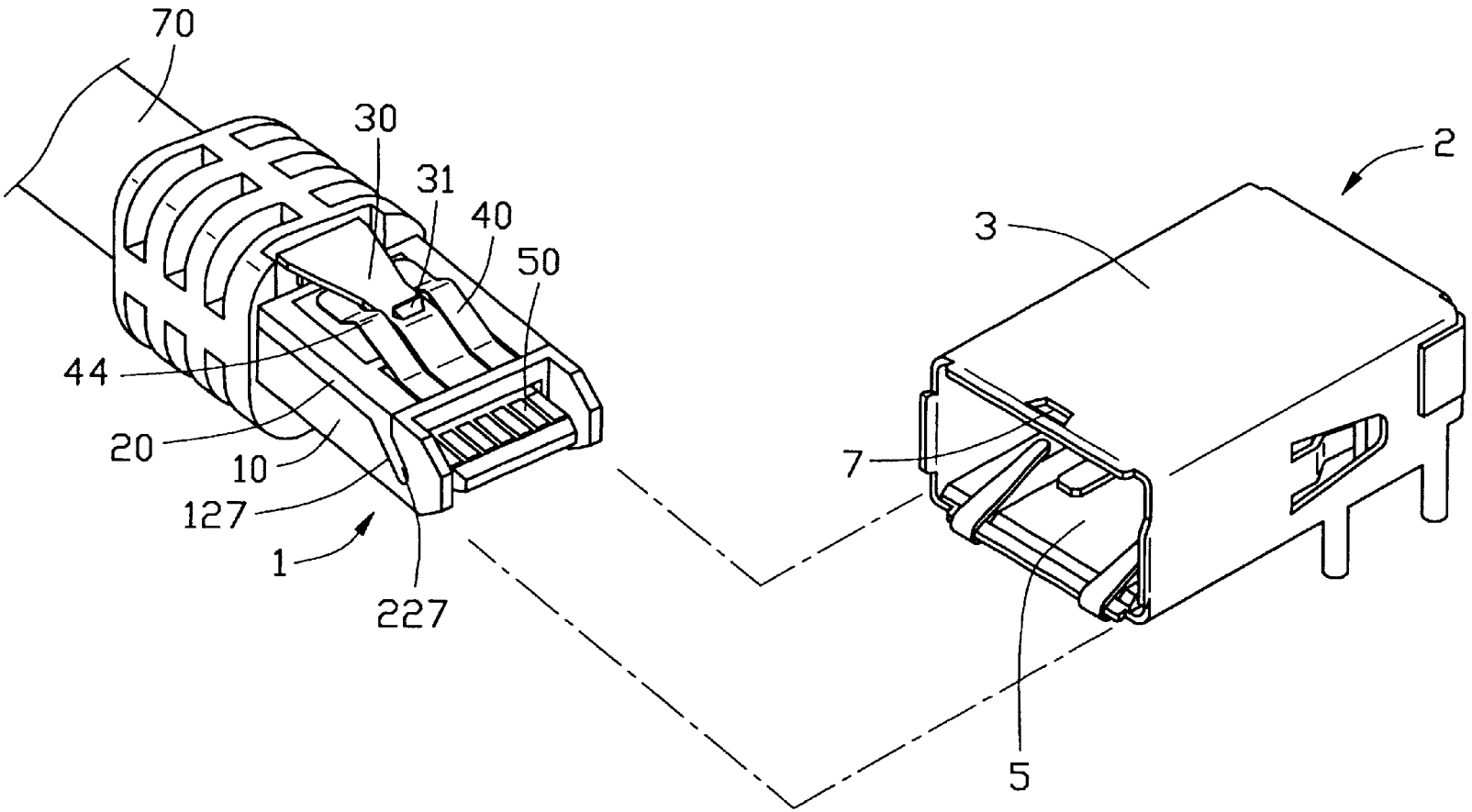
FIG. 6 is an assembled view of the plug connector of FIG. 1 with a complementary receptacle connector.
Figure 7:
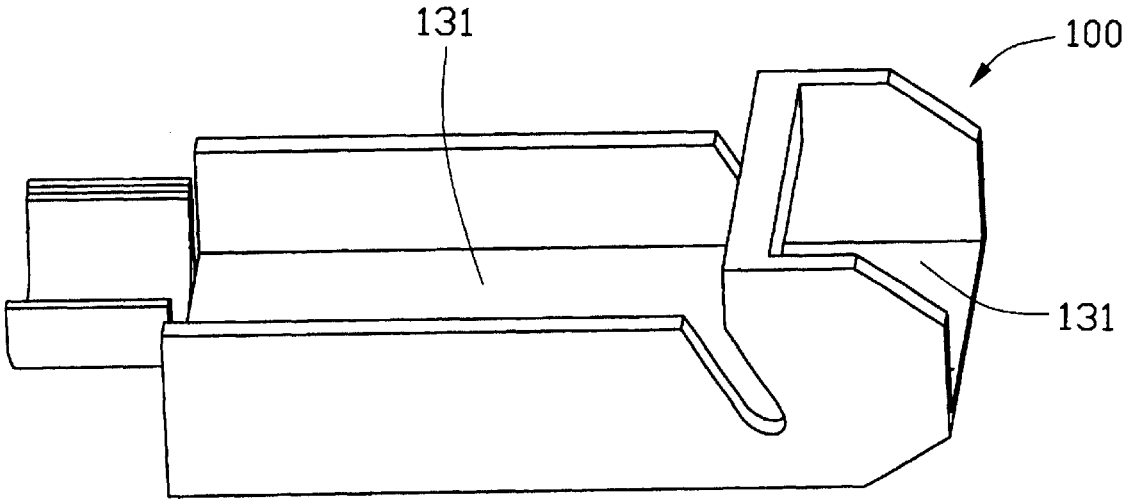
FIG. 7 is a perspective view of a housing of a second embodiment of the plug connector of the present invention.
Figure 8:
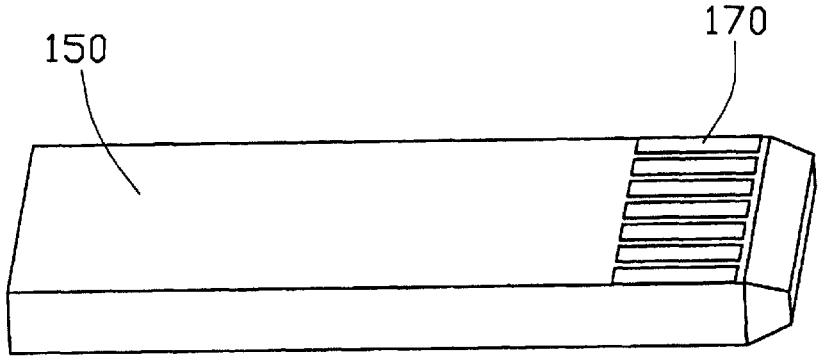
FIG. 8 is a perspective view of a printed circuit board of a second embodiment of the plug connector of the present invention.
Figure 9:
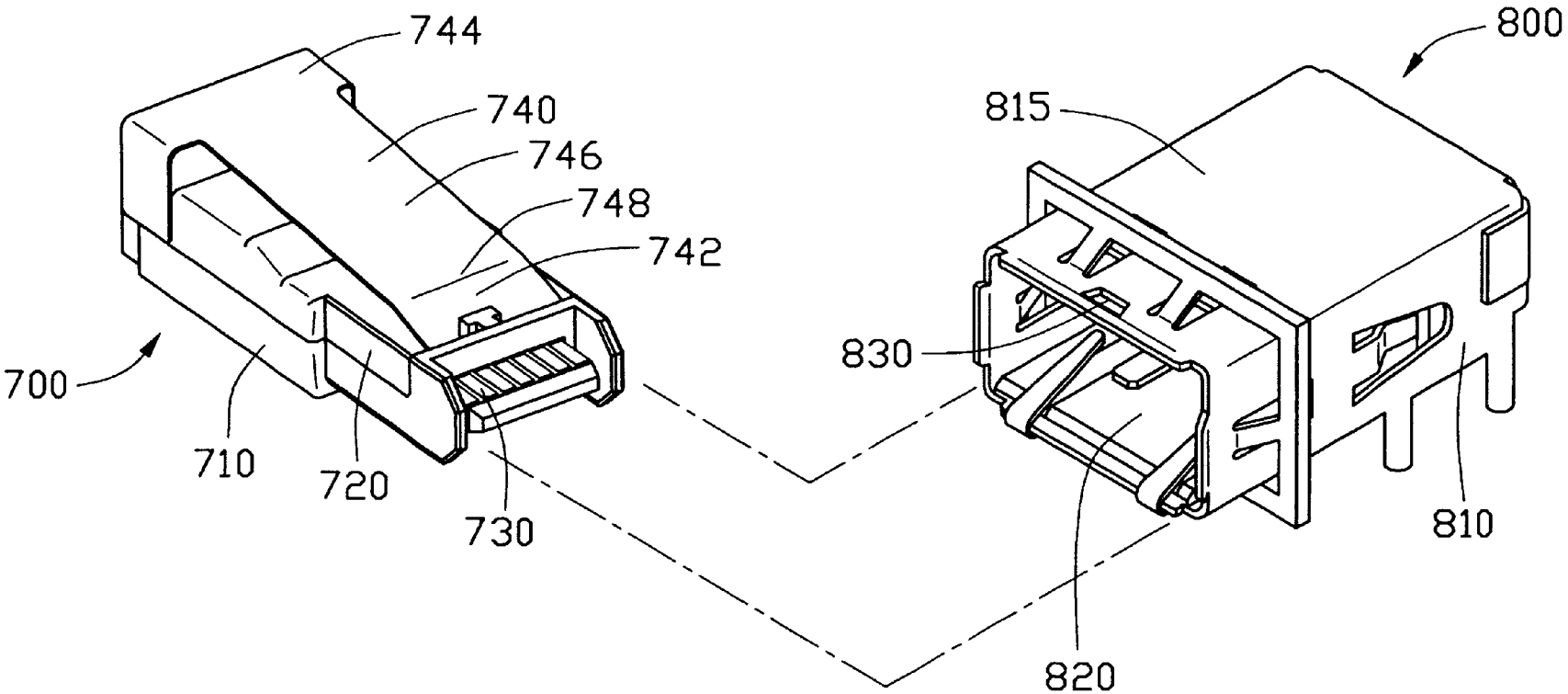
FIG. 9 (PRIOR ART)
FIG. 9 is a perspective view of a disconnected plug and receptacle connectors of the prior art.
Figure 10:
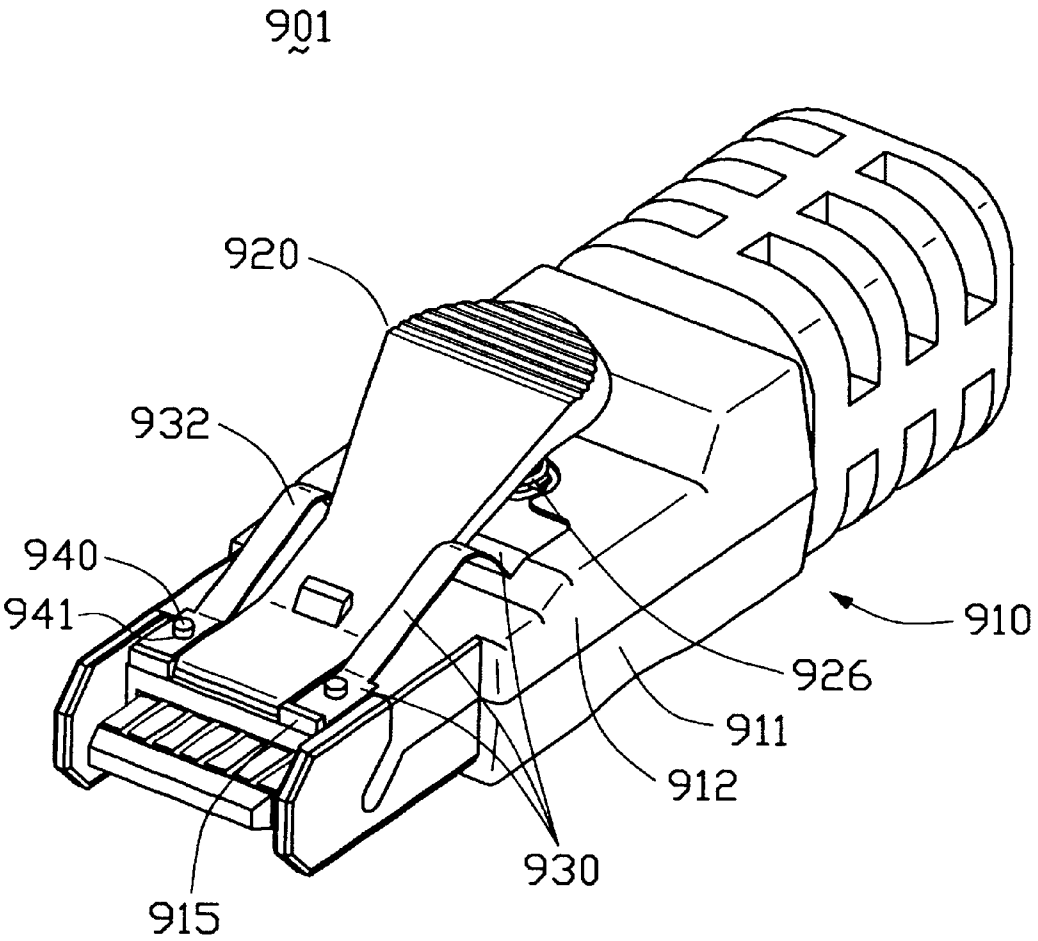
FIG. 10 (PRIOR ART)
FIG. 10 is a perspective view of a second plug connector of the prior art.

Referring to FIGS. 1, 7 and 8, the present invention is a small form factor plug connector 1 for high speed data transmission. A first embodiment, shown in FIG. 1, includes an insulative housing 10, an insulative insert 20, a plurality of contacts 50, a spring latch 30 made of an insulative material, and a conductive grounding clip 40. A second embodiment comprises a conductive housing 100 (see FIG. 7), the insert 20 of FIG. 1 being made of a conductive material, the insulative spring latch 30 of FIG. 1, the conductive grounding clip 40 of FIG. 1, and a printed circuit board 150 having golden fingers 170, as shown in FIG.8. The second embodiment is in keeping with other small form factor designs, and may be the more typical form of the invention. The plug connector 1 is designed to mate with a small form factor receptacle connector 2 (see FIG. 6) having a mating opening 5 in a front end thereof and an aperture 7 defined in a conductive upper side 3 thereof for engaging with the spring latch 30.

Figure 2:
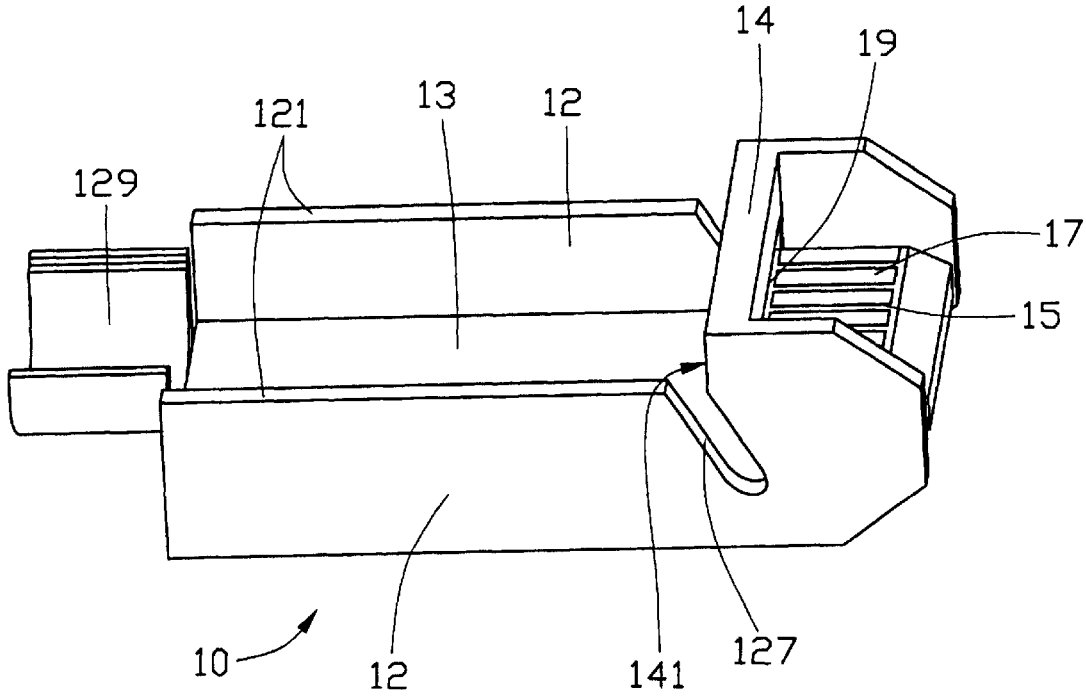
FIG. 2 is a perspective view of a housing of the plug connector of FIG. 1.

As shown in FIG. 2, the housing 10 is in the shape of a box and includes an opposing pair of sidewalls 12, with a bed 13, a top beam 14 and a front shelf 15 connecting the sidewalls 12 together. The sidewalls 12 each have an upper edge 121 and the top beam 14 has a rear face 141. The front shelf 15 is located in front of the bed 13. The front shelf 15 has a plurality of passageways 17 defined in a top surface (not labeled) thereof, the passageways 17 being in communication with a space (unlabeled) between the sidewalls 12 and above the bed 13. A slot 127 having a downward and forward slant is defined in each sidewall 12 from the upper edge 121 of each sidewall 12. A window 19 is formed between the top beam 14 and the front shelf 15.

Figure 3:
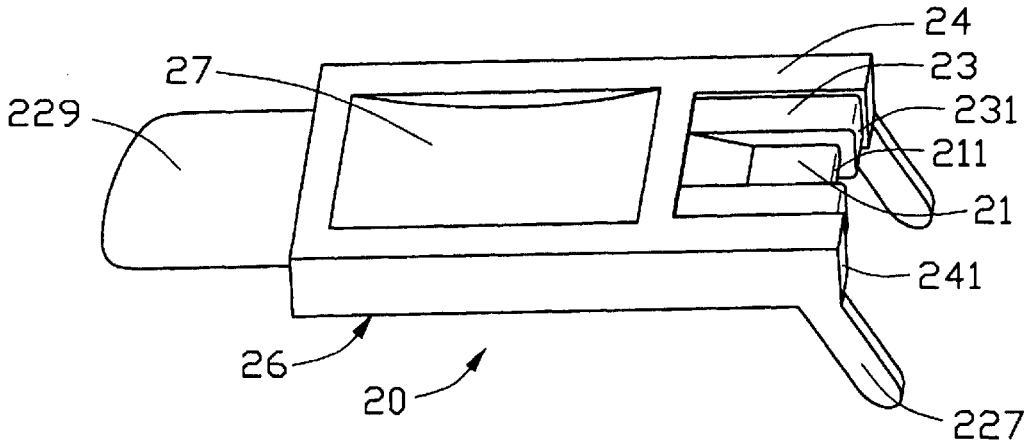
FIG. 3 is a perspective view of an insert of the plug connector of FIG. 1.

The insert 20 is shown in detail in FIG. 3 and has the general shape of a slab. A forward portion (not labeled) of the insert 20 forms a thin tongue 21 at its center, a pair of thicker support beams 23 flanking the tongue 21, and a pair of side beams 24 to the outer sides of the support beams 23. The support beams 23 are thinner than the side beams 24 and have forward faces 231 slightly recessed from forward surfaces 241 of the side beams 24. The tongue 21 is thinner than the support beams 23 and has a front edge 211 recessed from the forward faces 231 of the support beams 23. An anchoring leg 227 protruding downwardly and forwardly at an angle is formed at an outward side of each side beam 24. A concave depression 27 is defined in a rearward portion (not labeled) of the insert 20.

Figure 5:
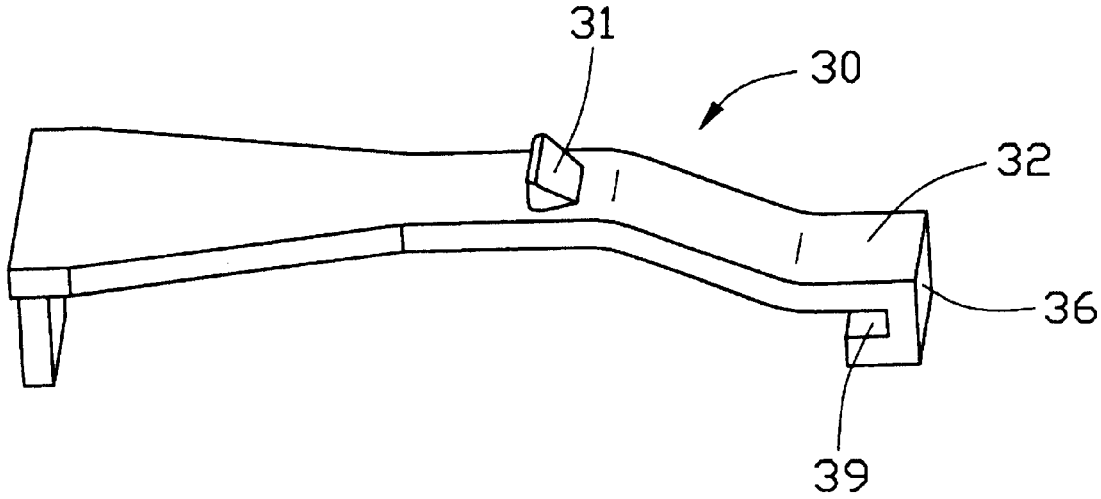
FIG. 5 is a perspective view of a spring latch of the plug connector of FIG. 1.

FIG. 5 shows details of the spring latch 30, which is made of a resilient material, such as plastic, and which is generally elongate in shape. A wedgeshaped lock 31 is formed on a top surface (not labeled) of the spring latch 30. A hook-shaped front end 32 of the spring latch 30 defines a groove 39 at a rearward side of the front end 32 and forms a front face 36 at a foremost position of the front end 32.

Figure 4:
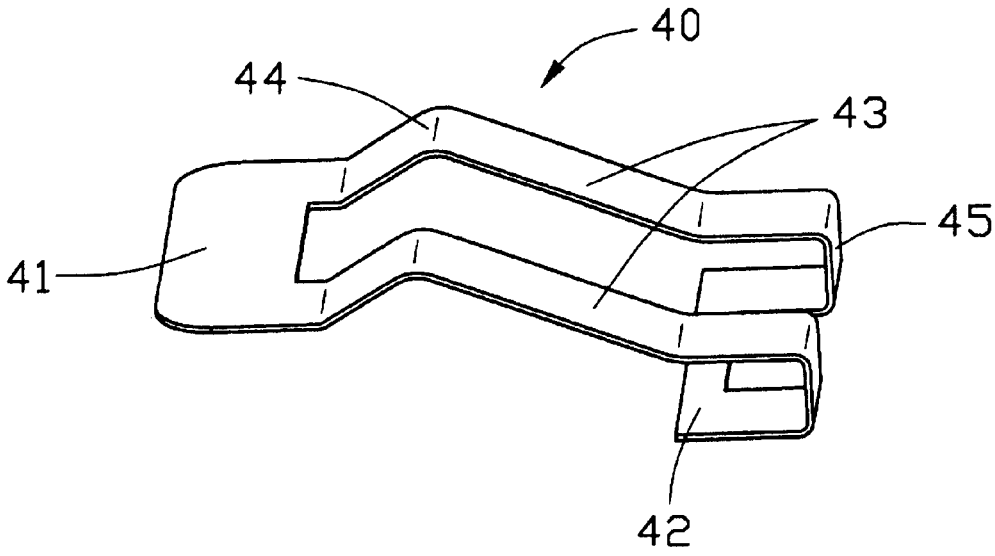
FIG. 4 is a perspective view of a grounding clip of the plug connector of FIG. 1.

The grounding clip 40 is shown in FIG. 4 and has four sides connected in an elongate ring. A wide rear side 41 and a narrow front side 42 are connected together by two narrow connecting sides 43. A forward portion (not labeled) of each connecting side 43 is downwardly bended into a hook shape and a rearward portion (not labeled) is upwardly bended to form a contact arch 44. The forward portion (not labeled) of each connecting side 43 forms a front face 45 at a foremost position thereof.

In assembly, referring to FIG. 6, the contacts 50 are inserted from the bed 13 into the passageways 17 of the housing 10. The grounding clip 40 is attached to the insert 20 by engaging the hook-shaped forward portions (not labeled) of the connecting sides 43 with the support beams 23 of the insert 20. The rear side 41 of the grounding clip 40 then rests on a top of the insert 20 in the concave depression 27 and the forward portions (not labeled) of the grounding clip 40 then abut the forward faces 231 of the support beams 23 of the insert 20. The spring latch 30 is then attached to the insert 20 with the front end 32 of the spring latch 30 engaging with the tongue 21 of the insert 20, the front edge 211 of the tongue 21 fitting into the groove 39 of the spring latch 30. When thus assembled, the front face 36 of the spring latch 30, the front faces 45 of the grounding clip 40, and the forward surfaces 241 of the insert 20 are all flush with one another.

Wires (not shown) in a cable 70 are then attached to rear sides (not labeled) of the contacts 50. The insert 20 is then assembled to the housing 10, the anchoring legs 227 of the insert 20 fitting into the slots 127 of the housing 10, until a bottom side 26 of the insert 20 abuts the upper edges 121 of the sidewalls 12 of the housing 10, and the front face 36 of the spring latch 30, the front faces 45 of the grounding clip 40, and the forward surfaces 241 of the insert 20 all abut the rear face 141 of the top beam 14 of the housing 10. Cable retainers 129, 229 integrally formed on the rear sides of, respectively, the housing 10 and the insert 20, can then be secured together using a ferrule or other means. Other means of engaging the insert 20 with the housing 10 can also be used, as is well known in the prior art.

The second embodiment of the plug connector 1 has the conductive housing 100 (see FIG. 7), which features a bed 131 extending from a front to a rear of the housing, with no front shelf 15 included. Referring to FIG. 8, instead of the contacts 50 being used, the second embodiment includes the printed circuit board 150, which is installed on the bed 131, the printed circuit board 150 having the plurality of golden fingers 170 adhering to a forward end thereof. The wires (not shown) of the cable 70 then attach to solder pads (not shown) on a rear end (not labeled) of the printed circuit board 150. Circuit traces (not shown) on or in the printed circuit board 150 connect the golden fingers 170 with respective solder pads on the rear end of the printed circuit board 150. A ferrule can then secure cable retainers of the housing 100 and the insert 20 together, as with the first embodiment. Other means of engaging the insert 20 with the housing 100 can also be used, as is well known in the prior art.

The assembled plug connector 1 provides an effective, high speed connector which can be efficiently assembled and which is robust in use. When the plug connector 1 is connected to the receptacle connector 2, a front (not labeled) of the plug connector 1 inserts into the mating opening 5 of the receptacle connector 2 and the lock 31 of the spring latch 30 engages with the aperture 7 of the receptacle connector 2, locking the plug connector I to the receptacle connector 2. The contact arches 44 of the grounding clip 40 resiliently engage with a grounding surface (not shown) of the receptacle connector 2, said grounding surface comprising the inner surface of the upper side 3 of the receptacle connector 2. The golden fingers 170 or contacts 50 of the plug connector 1 electrically connect to electrical terminals (not shown) in the receptacle connector 2. The spring latch 30 does not have the limitations of the prior art metal latch since its design and material make it more resilient than the prior art metal latch, and it is not subject to permanent deformation over the path in which it operates. The grounding clip 40 is also better protected from permanent deformation by the design of the contact arches 44 and the concave depression 27 into which they can be recessed. No coil spring is required in assembly, and assembly does not require a step of flattening retaining posts, as in one prior art connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug-type electrical connector for matingly plugging into a receptacle connector, comprising:

a housing;

a plurality of contacts mounted in the housing for electrically engaging with corresponding terminals in the receptacle connector;

an insert mountable to the housing;

a conductive grounding clip mountable to the insert for electrically engaging with a grounding surface of the receptacle connector; and a spring latch mountable to the insert and made of a resilient material and having a lock engagable with an aperture of the receptacle connector to lock the plug-type electrical connector to the receptacle connector; wherein the grounding clip is formed in the shape of an elongate ring with a forward side of the ring bent downward in a hook to clamp onto a front of the insert and a rearward side of the ring bent up in an arch to contact the grounding surface of the receptacle connector; wherein the spring latch is elongate and has a hook-shaped forward end for clamping to a front of the insert; wherein the spring latch is made of a plastic material.

2. The plug-type electrical connector as claimed in claim 1, wherein a depression is formed in a top surface of the insert to allow the grounding clip to resiliently recess into the depression, thereby protecting the grounding clip from permanently deforming.

3. A plug-type electrical connector for matingly plugging into a receptacle connector, comprising:

a housing;

a printed circuit board having a plurality of golden fingers adhering to a front end thereof, the printed circuit board being mounted in the housing with the golden fingers accessible for electrically engaging with corresponding terminals in the receptacle connector;

an insert mountable to the housing;

a conductive grounding clip mountable to the insert for electrically engaging with a grounding surface of the receptacle connector; and a spring latch mountable to the insert and made of a resilient material and having a lock engagable with an aperture of the receptacle connector to lock the plug-type electrical connector to the receptacle connector; wherein the grounding clip is formed in the shape of an elongate ring with a forward side of the ring bent downward in a hook to clamp onto a front of the insert and a rearward side of the ring bent up in an arch to contact the grounding surface of the receptacle connector; wherein the spring latch is elongate and has a hook-shaped forward end for clamping to a front of the insert; wherein the spring latch is made of a plastic material.

4. The plug-type electrical connector as claimed in claim 3, wherein a depression is formed in a top surface of the insert to allow the grounding clip to resiliently recess into the depression, thereby protecting the grounding clip from permanently deforming.

* * * * *